US006149126A

United States Patent [19]

Krimmer et al.

[11] Patent Number: 6,149,126

[45] Date of Patent: Nov. 21, 2000

[54] VALVE FOR THE METERED INTRODUCTION OF EVAPORATED FUEL

[75] Inventors: Erwin Krimmer, Pluederhausen; Wolfgang Schulz, Bietigheim-Bissingen; Tilman Miehle, Kernen; Manfred Zimmermann, Bad Rappenau; Maria Esperilla, Meimsheim, all of Germany

[73] Assignee: Robert Bosch GmbH, Stuttgart, Germany

[21] Appl. No.: 09/230,360

[22] PCT Filed: Feb. 18, 1998

[86] PCT No.: PCT/DE98/00472

§ 371 Date: Jan. 25, 1999

§ 102(e) Date: Jan. 25, 1999

[87] PCT Pub. No.: WO98/53195

PCT Pub. Date: Nov. 26, 1998

[30] Foreign Application Priority Data

May 23, 1997 [DE] Germany ..... 197 21 562

[51] Int. Cl.[7] ..... F02M 33/04

[52] U.S. Cl. ..... 251/118; 251/129.21; 123/516; 123/520

[58] Field of Search ..... 251/118, 129.21; 123/516, 519, 520

[56] References Cited

U.S. PATENT DOCUMENTS

| | | | |
|---|---|---|---|
| 4,763,635 | 8/1988 | Ballhause et al. | 123/520 |
| 4,901,702 | 2/1990 | Beicht et al. | 123/520 |
| 4,986,246 | 1/1991 | de Vivie et al. | 123/520 |
| 5,178,116 | 1/1993 | Fehrenbach et al. | 251/129.21 X |
| 5,188,141 | 2/1993 | Cook et al. | 123/520 X |
| 5,269,278 | 12/1993 | Heinemann et al. | 123/520 |
| 5,460,137 | 10/1995 | Zabeck et al. | 123/520 |
| 5,560,585 | 10/1996 | Krimmer et al. | 251/129.21 |
| 5,630,403 | 5/1997 | Kampen et al. | 123/520 |

*Primary Examiner*—John Rivell
*Attorney, Agent, or Firm*—Ronald E. Greigg; Edwin E. Greigg

[57] ABSTRACT

A fuel tank ventilation valve for a Laval nozzle, which has a sensitive regulation of the through flow quantity. The valve has a valve seat which is embodied on a valve seat body which has at least one opening that can be closed by the valve member. A cross section of the at least one opening is embodied as essentially smaller than an entry cross section of the Laval nozzle that is disposed spaced apart from the valve seat. The valve is suited for a metered introduction of fuel that has evaporated from a fuel tank of a mixture-compressing internal combustion engine with externally supplied ignition into an intake tube of the engine.

16 Claims, 2 Drawing Sheets

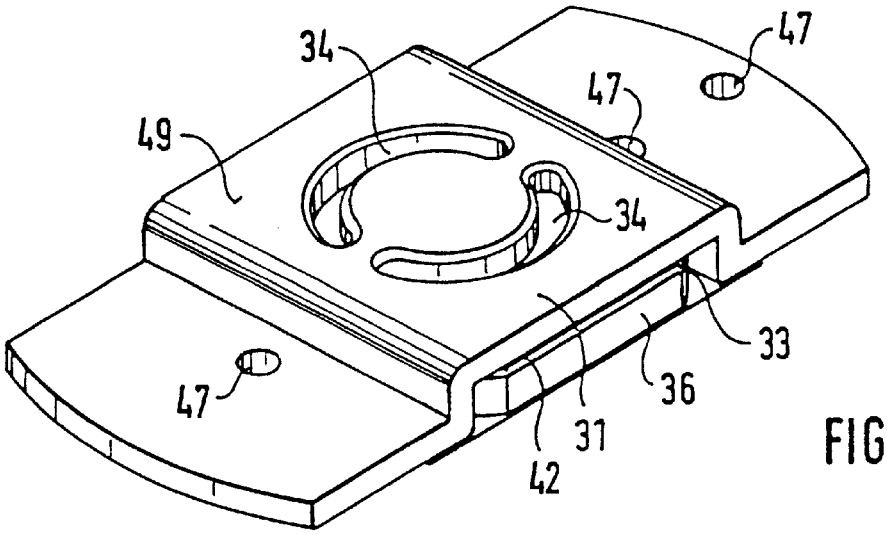
FIG. 2
FIG. 3
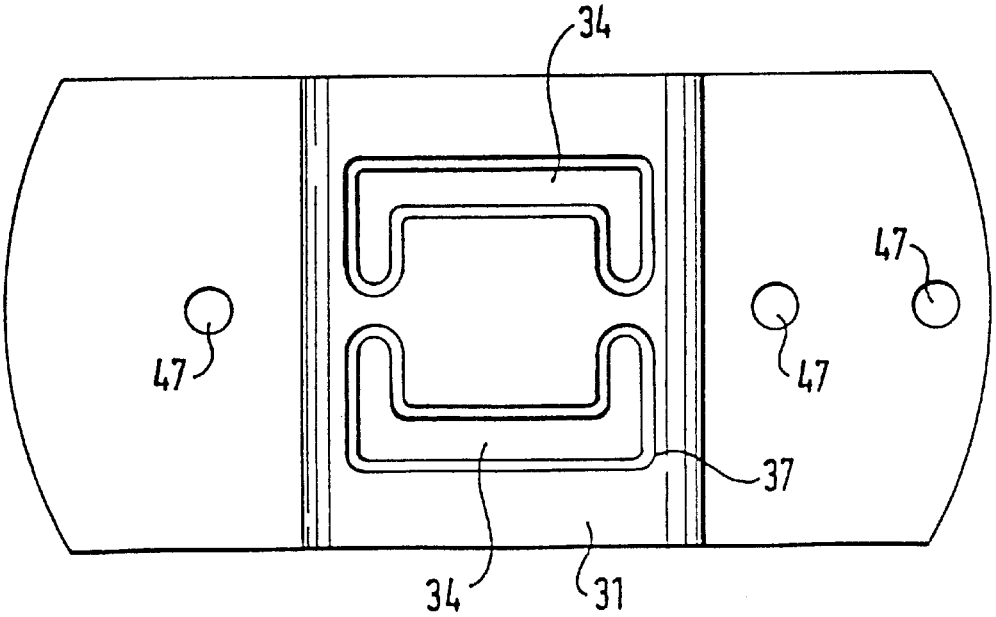

VALVE FOR THE METERED INTRODUCTION OF EVAPORATED FUEL

PRIOR ART

The invention is based on a valve for the metered introduction of fuel evaporated from a fuel tank of an internal combustion engine into an intake tube of the engine. A valve of this kind has already been disclosed (DE-PS 42 29 110), which has a valve seat that is formed on an edge of an inlet cross section of a Laval nozzle, which a cylindrical valve member, which can be actuated by an electromagnet, rests against in the closed position. The valve seat consequently also represents an axial boundary of the Laval nozzle. The embodiment of the nozzle as a Laval nozzle makes it possible to achieve a comparatively high through flow speed in order to thus produce only a relatively low flow resistance at a given flow rate of the valve. The problem of a sensitive regulation of the through flow quantity arises since the relatively large entry cross section of the Laval nozzle must always be covered directly by the valve member. Furthermore, a particular valve stroke of the valve member is required for a particular through flow quantity, but depends on the structural design of the Laval nozzle, particularly the dimensioning of its narrowest cross section, so that an adaptation of the characteristic curve of the valve can only occur by means of a structural change to the Laval nozzle form, which is, however, costly.

ADVANTAGES OF THE INVENTION

The valve according to the invention, has the advantage over the prior art that even with high through flows, only relatively low pressure differentials are needed at the valve. It is particularly advantageous that only a small valve stroke is required to control the through flow so that a valve can be produced which switches particularly rapidly and in which additionally, only slight dispersions of the through flow quantity occur. Advantageously, a valve characteristic curve can be produced in which, depending on the pressure differential, there is a quicker rise in the through flow characteristic curve at lesser pressure differentials and there is a uniform through flow at higher pressure differentials.

It is of particular advantage that the valve characteristic curve of the valve according to the invention can be easily changed.

BRIEF DESCRIPTION OF THE DRAWINGS

An exemplary embodiment of the invention is represented in a simplified manner in the drawings and will be explained in more detail in the description below.

FIG. 2 is a perspective representation of a valve seat body of the valve according to a first embodiment, and FIG. 3 is a bottom view of a valve seat body of the valve according to a second embodiment.

DESCRIPTION OF THE EXEMPLARY EMBODIMENT

Figure 1:
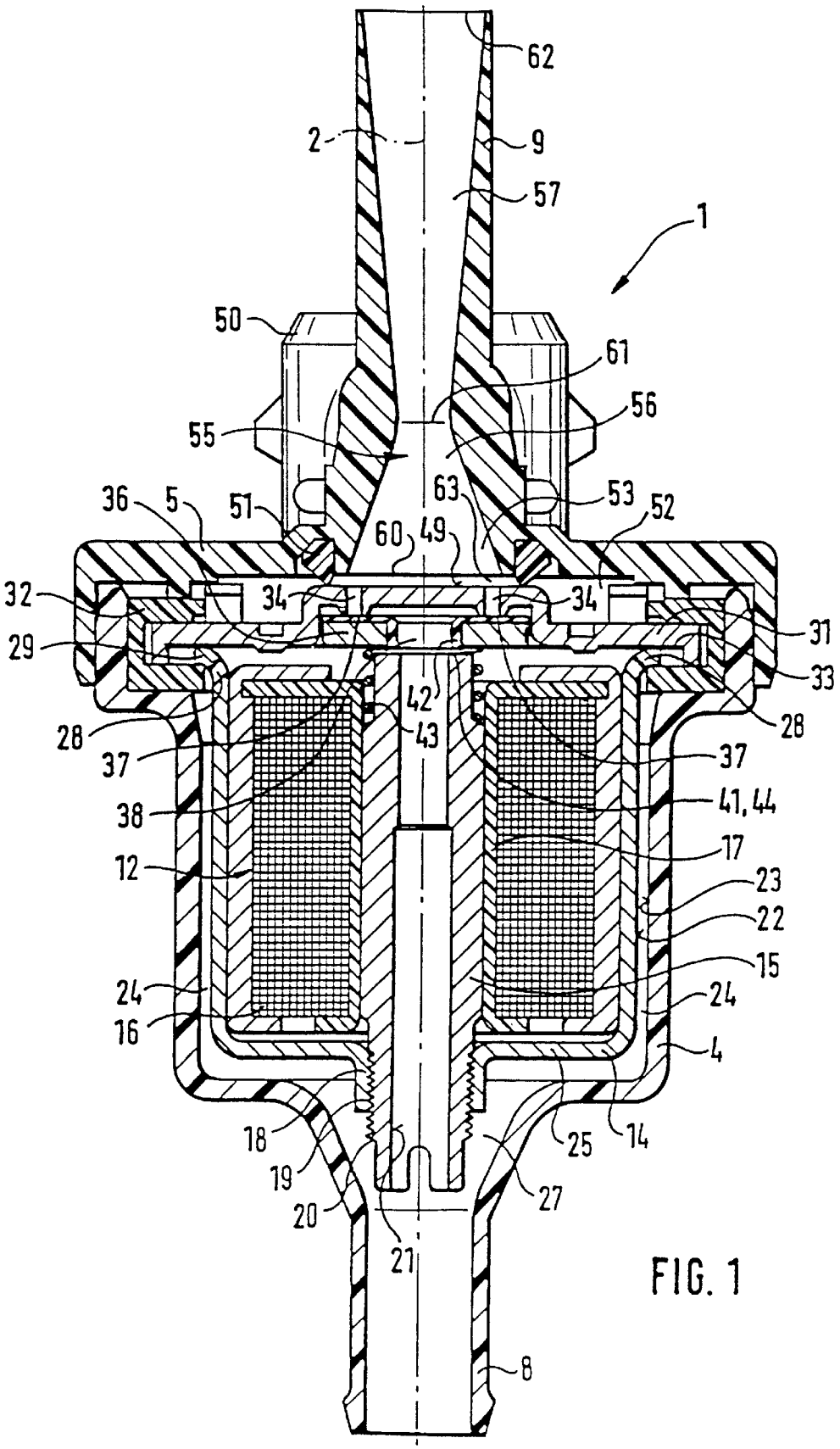
FIG. 1 is a longitudinal section through the valve according to the invention.

The valve 1 schematically represented in the longitudinal section in FIG. 1 is used for the metered introduction of fuel evaporated from a fuel tank of an internal combustion engine into an intake tube of the engine and is part of a fuel evaporation retention system, not shown in detail, of a mixture-compressing internal combustion engine with externally supplied ignition. The design and the function of this kind of fuel evaporation retention systems can be taken, for example, from the Bosch Technical Instruction, Motormanagement Motronic [Motor Management & Motor Electronics], second edition, August 1993, pp. 48 and 49. The design and function of a valve 1 of this kind, which is also called a regenerating valve or a tank ventilation valve, is furthermore known to one skilled in the art from the German Patent Disclosure 40 23 044, whose disclosure is intended to be a component of the current patent application.

Coaxial to a valve longitudinal axis 2, the valve 1 has a two-part valve housing with a cylindrically stepped, sleeve-shaped lower housing part 4 and a cover-shaped upper housing part 5. The upper housing part 5, for example, is placed onto the lower housing part 4 and thereby engages the lower housing part 4 on its outer surface. Both housing parts 4, 5 are preferably comprised of plastic and are, for example, non-detachably connected, e.g. by means of ultrasonic welding or also detachably connected, e.g. by means of a detent connection. The lower housing part 4 has an inflow fitting 8 for connecting to a ventilation fitting, not shown, of a fuel tank of the engine or to an adsorption filter that follows the fuel tank. The adsorption filter is used in a known manner for temporarily storing evaporated fuel vapor from the fuel tank and is filled, for example, with activated charcoal. The upper housing part 5 has an outflow fitting 9 for connecting to an intake tube of the engine. The inflow fitting 8 and the outflow fitting 9 are respectively disposed axially in the housing parts 4 and 5, approximately flush with each other. An electromagnet 12 is disposed on the inside of the lower housing part 4. It has a cup-shaped magnet housing 14 with a coaxial, hollow cylindrical magnet core 15 that passes through a bottom 25 of the magnet housing 14, and a cylindrical excitation coil 16, which sits on a coil support 17 and rests in the magnet housing 14, encompassing the magnet core 15. An outwardly protruding threaded fitting 18 with an internal thread 19 is embodied of one piece at the bottom 25 of the magnet housing 14 and an externally threaded section 20 on the hollow cylindrical magnet core 15 is screwed into this internal thread. By turning the magnet core 15, it can be moved axially in the magnet housing 14 for adjustment purposes. The magnet core 15 has an axial through opening 21 that is defined by the hollow magnet core 15 so that fuel vapor in the through opening 21 can flow from the inflow fitting 8 to the outflow fitting 9.

The magnet housing 14 with the magnet core 15 is inserted into the lower housing part 4 so that axial conduits 24 remain between an outer jacket 22 of the magnet housing 14 and an inner wall 23 of the lower housing part 4, and these axial conduits are offset from one another, for example in the circumference direction, by equal angles so that as shown in FIG. 1, for example, only two axial conduits 24 can be seen. On one end, the axial conduits 24 communicate with the inflow fitting 8 by way of an annular chamber 27 disposed in the lower housing part 4 between the bottom 25 of the magnet housing 14 and the inflow fitting 8 and on the other end, they communicate with the inside of the magnet housing 14 downstream of the excitation coil 16 by means of bores 28 that are let into the magnet housing 14 close to the open end of the magnet housing 14. The fuel vapor entering the inflow fitting 8 can also flow around the magnet housing 14 by means of these axial conduits 24 and can thus dissipate heat produced here.

The magnet housing 14 has a curved rim 29, which is used as a support flange for a yoke-shaped valve seat body 31. The valve seat body 31 constitutes the magnetic yoke of the electromagnet 12. The valve seat body 31 partially covers the magnet housing 14 and is fastened to the lower housing part 4 by means of at least two alignment holes 47 depicted in FIGS. 2 and 3. The valve seat body 31 disposed on the rim 29 is thereby received in an elastic, annular bearing receptacle 32 with a U-shaped cross section, which for its part, is clamped between the two housing parts 4 and 5. A valve member 36 comprised of magnetic material simultaneously constitutes the armature of the electromagnet 12 and is fastened to a leaf spring 33, which is clamped on the rim end between the valve seat body 31 and the rim 29. The valve seat body 31 has at least one valve opening 34. In the exemplary embodiment, two gap-shaped valve openings 34 are provided which, as shown in FIG. 2, have a semicircular shape, for example, and are disposed opposite each other so that they supplement each other to form an imaginary circular shape. It is, however, also possible, as depicted in FIG. 3, a top view of the valve seat body 31 embodied according to a second embodiment type, to embody the valve openings 34 in a U-shape, which can complement each other to form an imaginary rectangle. The two valve openings 34 can be closed by the valve member 36 so that a double valve seat 37 is produced. As shown in FIG. 1, a through opening 38 is provided in the valve member 36 and extends coaxially in relation to the hollow cylindrical magnet core 15, and fuel flowing from the inflow fitting 8 by way of the through opening 21 of the magnet core 15 can flow by way of this through opening 38 into the outflow fitting 9 when the valve openings 34 are open. The valve member 36 is acted on in the valve closing direction toward the outflow fitting 9 by a valve closing spring 43, which is supported on the one end against the valve member 36 and on the other end, is supported against a sleeve-shaped end 41 of the magnet core 15.

On its end oriented toward the double valve seat 37, the valve member 36 has a seal 42 made of elastic material, for example elastomer. The seal 42 also lines the through opening 38 and protrudes slightly beyond a side of the valve member 36 remote from the double valve seat 37. When the electromagnet 12 is without current, the valve closing spring 43 presses the valve member 36 with the seal 42 onto the double valve seat 37 and thereby closes the valve openings 34. When the electromagnet 12 is supplied with current, the valve member 36 is pressed with its seal 42, which protrudes from the through opening 38, against the end 41 of the magnet core 15, which forms a stop 44 for the stroke motion of the valve member 36. By means of the adjusting thread constituted by the internal thread 19 of the threaded fitting 18 of the magnet housing 14 and by the externally threaded section 20 of the magnet core 15, the stop 44 can be moved axially and as a result, the through flow quantity when the valve member 36 is maximally lifted from the double valve seat 37 can be determined. The valve closing spring 43 is weakly dimensioned since when there is a pressure drop between the outflow fitting 9 and the inflow fitting 8, a suction effect is exerted on the valve member 36 in the direction of closing the valve and the closing action of the valve closing spring 43 is encouraged. During operation of the engine, the electromagnet 12 is triggered cyclically by the control electronics of a control device that is not shown in detail, and a plug connection 50 for this purpose is provided on the upper housing part 5. The clock pulse rate is predetermined by the operating state of the engine so that the through flow quantity of evaporated fuel vapor traveling from the inflow fitting 8 into the outflow fitting 9 by way of valve openings 34 can be correspondingly metered.

A sealing ring 51 rests against the side 49 of the valve seat body 31 oriented toward the outflow fitting 9 and seals an outer annular chamber 52 between the valve seat body 31 and the upper housing part 5 from an internal chamber 53 that is disposed in the outflow fitting 9 and communicates with the valve openings 34. The conduit that passes through the outflow fitting 9 is embodied in the form of a Laval nozzle 55, which is comprised in a known manner of a convergent part 56 and a divergent part 57. The Laval nozzle 55 tapers from a first entry cross section 60 in the downstream vicinity of the valve seat body 31, down to a narrowest cross section 61 and then from this narrowest cross section 61, widens to an end cross section 62 on the downstream end. The embodiment of the cross sections 60, 61, 62 is executed in such a way that the entry cross section 60 is at least equal to or greater than the end cross section 62. Preferably, the entry cross section 60 is 1.1 to 2 times greater than the end cross section 62. The narrowest cross section 61 is preferably embodied as 2 to 4 times smaller than the entry cross section 60.

The length of the Laval nozzle 55 measured between the entry cross section 60 and the end cross section 62 is for example 3 to 5 times greater than a diameter at the entry cross section 60. The side 49 of the valve seat body 31, in the direction of the valve longitudinal axis 2, has a spacing from the entry side of the outflow fitting 9 that has the entry cross section 60 so that an intermediary space 63 is formed between the side 49, the entry side of the outflow fitting 9, and the sealing ring 51, which has at least one lateral extension perpendicular to the valve longitudinal axis 2, that is as great as the diameter of the entry cross section 60 and the valve openings 34 feed into this intermediary space 63. Since only the two valve openings 34 of the valve seat body 31 have to be covered by the valve member 36 for the diversion, it is possible, by means of a simple change to the valve stroke of the valve member 36, to optimally adapt it to the narrowest cross section 61 of the Laval nozzle 55 without requiring a change in the dimensional ratios of the cross sections of the Laval nozzle 55 for this purpose. The cross sections of the two valve openings 34 are essentially embodied as smaller than an entry cross section 60 of the Laval nozzle 55.

The foregoing relates to a preferred exemplary embodiment of the invention, it being understood that other variants and embodiments thereof are possible within the spirit and scope of the invention, the latter being defined by the appended claims. Preferably the two cross sections together amount to only approx. 10 to 20 percent of the entry cross section 60. Due to the relatively small cross section of the two valve openings 34, the interruption of the fuel flow by means of the valve member 36 can be carried out at a high speed so that a valve 1 can be produced that switches particularly rapidly. The adaptation to desired through flow quantities of the valve 1 is possible by means of a simple change to the valve stroke or by means of turning the magnet core 15 in the magnet housing 14.

What is claimed is:

1. A valve for a metered introduction of fuel evaporated from a fuel tank of an internal combustion engine into an intake tube of the engine, comprising a valve housing with a valve longitudinal axis, said valve housing has an inflow fitting for connection to a fuel tank or an adsorption filter following the fuel tank that is for the passage of the evaporated fuel, an outflow fitting for connection to the intake tube, a valve member which is accommodated on an inside of the valve housing between the inflow fitting and the outflow fitting, said valve member is actuated by an electromagnet that has a magnet core and cooperates with a valve seat embodied on a valve seat body, a nozzle embodied in the outflow fitting, said nozzle has a convergently embodied part and a divergently embodied part, the valve seat (37) and an entry cross section (60) of the nozzle (55) have a spacing from each other in a direction of the valve longitudinal axis (2).

2. The valve according to claim 1, in which the valve seat body (31) and the outflow fitting (9) are embodied as separate parts.

3. The valve according to claim 1, in which the valve seat body (31) constitutes a magnetic yoke of the electromagnet (12) and is accommodated in the valve (1) spaced apart from the entry cross section (60) of the nozzle (55).

4. The valve according to claim 2, in which a sealing ring (51) is provided between the valve seat body (31) and the outflow fitting (9).

5. The valve according to claim 1, in which the cross section of an at least one opening (34) which is encompassed by the valve seat (37) and is disposed in the valve seat body (31) is embodied as significantly smaller than the entry cross section (60) of the nozzle (55).

6. The valve according to claim 5, in which the cross section of the at least one opening (34) is approximately 10 to 20 percent the entry cross section (60) of the nozzle (55).

7. The valve according to claim 5, in which two openings (34) are provided in the valve seat body (31), which have a semicircular shape or a U-shape.

8. The valve according to claim 1, in which the entry cross section (60) of the nozzle (55) is at least 1.1 to 2 times greater than an end cross section (62) of the nozzle (55).

9. The valve according to claim 1, in which a length of the nozzle (55), measured between the entry cross section (60) and an end cross section (62), is 3 to 5 times greater than a diameter at the entry cross section (60).

10. The valve according to claim 1, in which the cross sectional transitions of the nozzle (55) are embodied so that they continuously transition into one another.

11. The valve according to claim 1, in which the valve stroke of the valve member (36), which is produced between a contact of the valve member (36) against the valve seat body (31) and a contact against the magnet core (15) is selected as a function of a narrowest cross section (61) of the nozzle (55).

12. The valve according to claim 11, in which a valve stroke of the valve member (36) can be adjusted by adjustment of the magnet core (15) longitudinally.

13. The valve according to claim 2, in which the valve seat body (31) constitutes a magnetic yoke of the electromagnet (12) and is accommodated in the valve (1) spaced apart from the entry cross section (60) of the nozzle (55).

14. The valve according to claim 3, in which a sealing ring (51) is provided between the valve seat body (31) and the outflow fitting (9).

15. The valve according to claim 13, in which a sealing ring (51) is provided between the valve seat body (31) and the outflow fitting (9).

16. The valve according to claim 6, in which two openings (34) are provided in the valve seat body (31), which have a semicircular shape or a U-shape.

* * * * *